US008508153B2

(12) United States Patent
Arciuolo

(10) Patent No.: US 8,508,153 B2
(45) Date of Patent: Aug. 13, 2013

(54) ELECTRICAL DEVICE FOR END USER CONTROL OF ELECTRICAL POWER AND LIGHTING CHARACTERISTICS

(75) Inventor: Thomas F. Arciuolo, Milford, CT (US)

(73) Assignee: Ultimate Interfaces Corporation, Milford, CT (US)

( * ) Notice: Subject to any disclaimer, the term of this patent is extended or adjusted under 35 U.S.C. 154(b) by 1019 days.

(21) Appl. No.: 12/371,615

(22) Filed: Feb. 15, 2009

(65) Prior Publication Data

US 2010/0207541 A1 Aug. 19, 2010

(51) Int. Cl.

| | |
|---|---|
| ***H05B 37/02*** | (2006.01) |
| ***H05B 41/36*** | (2006.01) |
| ***H05B 39/04*** | (2006.01) |
| ***G05F 1/00*** | (2006.01) |

(52) U.S. Cl.

USPC ..... 315/294; 315/209 R

(58) Field of Classification Search

None

See application file for complete search history.

(56) References Cited

U.S. PATENT DOCUMENTS

| | | | | |
|---|---|---|---|---|
| 4,156,891 | A | 5/1979 | Roche | |
| 4,339,690 | A | 7/1982 | Regan et al. | |
| 5,130,608 | A * | 7/1992 | Zahardis | 315/209 R |
| 5,303,124 | A * | 4/1994 | Wrobel | 362/20 |
| 5,343,122 | A * | 8/1994 | Sugimori et al. | 315/209 R |
| 5,688,042 | A | 11/1997 | Madadi et al. | |
| 5,734,229 | A | 3/1998 | Bavaro et al. | |
| 6,356,038 | B2 | 3/2002 | Bishel | |
| 6,573,665 | B2 | 6/2003 | Cooper et al. | |
| 6,599,000 | B2 | 7/2003 | Nolan et al. | |
| 6,609,804 | B2 | 8/2003 | Nolan et al. | |
| 6,734,641 | B2 | 5/2004 | Shoji et al. | |
| 6,819,061 | B2 | 11/2004 | Danjo et al. | |
| 6,936,968 | B2 * | 8/2005 | Cross et al. | 315/74 |
| 7,190,127 | B2 * | 3/2007 | Rudolph | 315/309 |
| 7,868,482 | B2 * | 1/2011 | Greene et al. | 307/82 |
| 2004/0156199 | A1 | 8/2004 | Rivas et al. | |
| 2005/0093475 | A1 * | 5/2005 | Kuennen et al. | 315/209 R |
| 2005/0122723 | A1 | 6/2005 | Frederick | |
| 2005/0225257 | A1 * | 10/2005 | Green | 315/209 R |
| 2006/0232220 | A1 * | 10/2006 | Melis | 315/209 R |

* cited by examiner

*Primary Examiner* — Crystal L Hammond

(74) *Attorney, Agent, or Firm* — Kilpatrick, Townsend & Stockton, LLP.

(57) ABSTRACT

This disclosure is an electronic machine, used in standard electrical lamps and lighting fixtures that operate on AC voltage. Installed between the lamp fixture and the standard incandescent/halogen light bulbs that are normally installed into it, the device performs its function of providing user control of the light generation process. By selecting the similarity/dissimilarity of the wattage of each plural light bulbs that are installed into the device, the user has the ability to modify the operational characteristics of the light bulbs, between either improved energy efficiency/light quality and whiteness, or extended light bulb life/lighting coloration. Also, the device extends the amount of time it takes to turn-on the light bulbs' filaments, providing additional extension of the light bulbs' life expectancy.

16 Claims, 3 Drawing Sheets

ELECTRICAL DEVICE FOR END USER CONTROL OF ELECTRICAL POWER AND LIGHTING CHARACTERISTICS

BACKGROUND OF THE INVENTION

1. Field of the Invention

The present invention relates to providing user control of inherent light bulb characteristics designed into them by their manufacturers. The characteristics controlled by the invention include: power consumption, energy efficiency, life span/burn time, light quality/whiteness, ambient lighting coloration, and light bulb turn-on speed.

2. Discussion of the Prior Art

Until now, all of these light bulb characteristics, designed into the light bulbs by their manufacturers, were preset and virtually unchangeable. For example, if a consumer buys a standard 120 VAC, 100 W incandescent light bulb, it is certain to use 100 W of power, last the manufacturer specified number of hours, output a specific number of lumens of light, have a specific energy efficiency rating, general color rendering index, and correlated color temperature. The light bulb can also be counted on to turn-on abruptly when the power is applied to it, to its detriment. With this embodiment of the present invention, all of these characteristics are now adjustable and settable by the user, simply by choosing the appropriate wattage ratings of the light bulbs installed into the device, which is plugged into the lamp fixture.

SUMMARY OF THE INVENTION

It is an objective of my invention to provide a small size and inexpensive means to effect user control of the illumination process.

It is another objective of my invention to convert the AC input voltage into a DC voltage distributed across plural illuminating resistive loads placed in series.

In one embodiment of the present invention, the user may choose to install into the device two 100 W incandescent light bulbs for an application requiring some energy savings, extended light bulb life and colorful light, for example in a ceiling or attic lamp fixture where changing the bulbs is difficult and is desired to do as infrequently as possible. This "Bulb Saver Mode" of operation provides all of these benefits, including greatly extended bulb operating life, many times its original rating, but with decreased energy efficiency.

In another embodiment of the present invention, the user may choose to install into the device one 40 W incandescent light bulb and one 100 W incandescent light bulb for an application requiring greatly improved energy efficiency, great energy savings, and very white light, for example in a table, reading light. This "Energy Efficiency Mode" of operation provides all of these benefits, including greatly improved energy efficiency, but with decreased light bulb life.

No matter what mode of operation is selected the device provides for a slower light bulb turn on speed. This feature serves to extend light bulb life expectancy by preventing or at least reducing a premature light bulb blowout. By slowing the light bulb turn-on speed, this extends the period of time it takes for the filaments to achieve full illumination. This extended turn-on time period serves to decrease thermal shock to the bulbs' filament, as well as reducing current surge through the filaments at startup, all to help prevent or minimize filament burn out during this initial startup period, when the filaments are most vulnerable to blowout.

Through the use of embodiment of the invention, the user is put in control of how their energy is used, money is spent, and illumination characteristics that matter most to them for a particular application can be achieved.

DETAILED DESCRIPTION OF THE INVENTION

This embodiment illustrated in the figures is an electrical device used in standard household lighting fixtures that operate at 120 VAC and use standard incandescent or halogen light bulbs, such as those found in the United States and Canadian markets. The device could be easily resized for other alternating voltages such as used in different countries.

The device screws into the lighting fixture where the light bulb is normally installed. Into this device are screwed plural standard incandescent or halogen light bulbs that operate on AC voltage. Typically, the plural bulbs' wattage values are what determine the operational characteristics of the device and what benefits the user of the device will achieve.

Reference is now taken to the figures, wherein the schematic circuit of the embodiment illustrated in the figures is illustrated in its entirety, with all electrical elements for the conversion of AC to DC, safety, and power distribution across illuminated, resistive loads connected in series.

Figure 1:
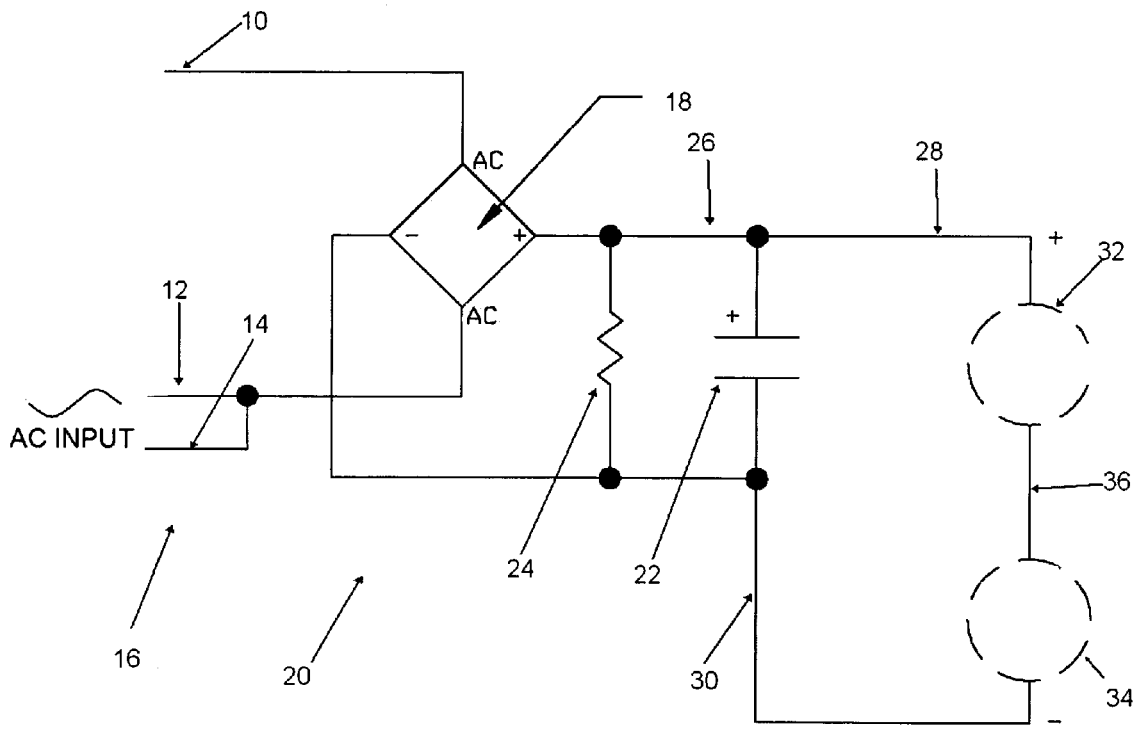
FIG. 1 illustrates schematically an embodiment of the invention.
Figure 2:
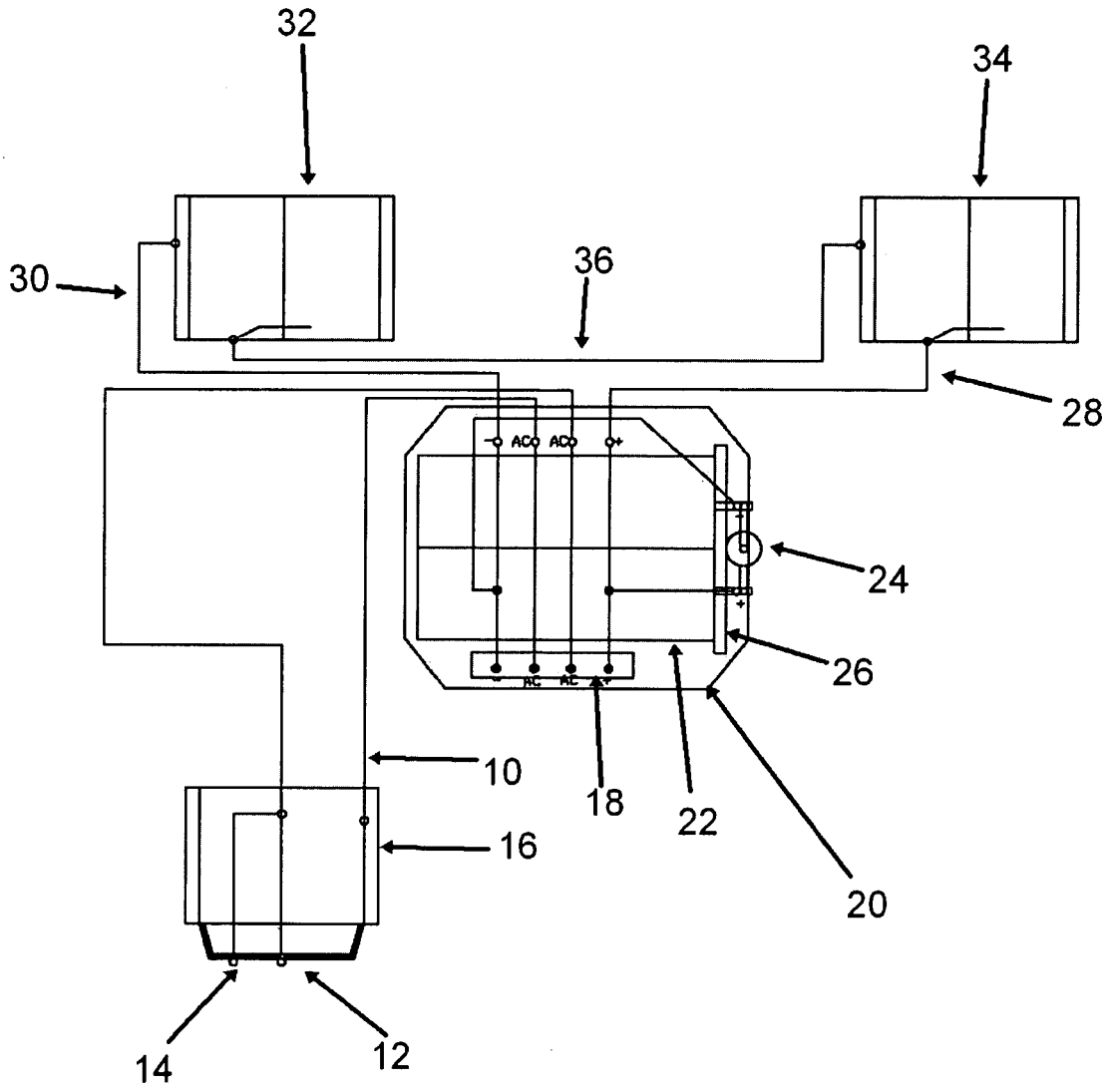
FIG. 2 illustrates electronics corresponding to the schematic illustrated in FIG. 1.

Turning to FIGS. 1 and 2, the AC power input is shown propagating in the form of a sine wave. Power input leads 10, 12 and 14 are disposed in a base 16. The leads 10-14 conduct the AC power to a full wave bridge rectifier 18 for conversion to a full wave rectified AC wave form. A suitable full wave bridge rectifier 16 is part number GBU-1002 from Diodes, Incorporated, 15660 N. Dallas Parkway, Suite 850 Dallas, Tex. 75248 USA. This particular full wave bridge rectifier is a 10.0 A Glass Passive Bridge Rectifier, providing 200 Vdc voltage and 140 Vac (RMS) voltage.

The rectifier 18 is connected to a printed circuit board 20 and therethough is electrically connected to an electrolytic capacitor 22. The capacitor 22 is used for conversion to a DC voltage. A suitable electrolytic capacitor 22 is a large can aluminum electrolytic capacitor, part number SM2D122M-2540, from Delcon Industries Co., Ltd.RM115, 1/F, Lee Hang Industrial Building, No. 10 Cheung Yue Street, Kowloon, Hong Kong This particular capacitor provides a capacity of 120 μF, 200 Vdc working voltage and 250 Vdc surge voltage, a maximum amperage of 3.5 Arms at 120 Hz at up to 85 degrees C., and a maximum impedance of 0.166 ohms at 120 Hz at 20 degrees C.

The capacitor 22 is responsible for:

i) Wave form filtration;

ii) Energy storage;

iii) Introducing a reactive component into the power factor, i.e. power factor<1;

iv) Adding a slowdown of the illumination of the light bulbs upon initial turn-on; and v) Serving as a lighting ballast given its relatively large size.

Connected to the capacitor 22 is a resistor 24 via a breakaway circuit board 26. The responsibility and purpose of the resistor 24 is ensuring a safe and timely discharge of the capacitor 22, when the capacitor 22 is fully charged, after the AC voltage is removed from leads 10, 12, and 14, without interfering with the operation of the device. A suitable resistor 24 is 32 KΩ, single watt, carbon film resistor, part number CR1W32KJ, from the above identified Delcon Industries.

Leads 28 and 30 extend away from the circuit board 20 and connect to respective loads 32 and 34. Lead 36 connects the loads 32 and 34 in series. Because of this load connection configuration powered by the DC voltage applied across leads 28 and 30, the user can choose the loading ratio between loads 32 and 34. This is done by choosing the wattage of the plural (e.g. two)—light bulbs installed in the circuit at loads 32 and 34, noting that different wattage light bulbs have different resistance load values.

Energy efficiency is increased in Energy Saver Mode by applying an increased average voltage to one of the filaments. As this applied average voltage is increased the incandescence process in both incandescent and halogen light bulbs naturally becomes more efficient. Likewise, as this average voltage is decreased to the light bulb filaments, as in Bulb Saver Mode, the lifespan of the light bulbs is naturally extended. Without wishing to engage in theory, it is assumed that the relationship between the parameters used in the embodiment illustrated in the figures is well known in the art:

EQUATIONS

Loading Ratio=load 32/load 34 i)

load 32=((DC Voltage/(load 32+load 34))×load 32) ii)

load 34=((DC Voltage/(load 32+load 34))×load 34) iii)

EXAMPLE 1

Bulb Saver Mode i) two—100 W incandescent light bulbs are installed in the embodiment illustrated in the figures at 120 VAC (RMS).
ii) DC Voltage=170 VDC
iii) Each bulb has a resistance value of 144 ohms.

So:
i) Loading Ratio=1, i.e. symmetrical lighting
ii) load 32=85 VDC
iii) load 34=85 VDC Each light bulb generates an equal amount of warm colorful light, and has a greatly extended life span, but with decreased energy efficiency.

EXAMPLE 2

Energy Saver Mode i) one—100 W incandescent light bulb and one—40 W incandescent light bulb are installed in the embodiment illustrated in the figures at 120 VAC (RMS).
ii) DC Voltage=170 VDC
iii) load 32 (100 W light bulb) has a resistance value of 144 ohms.
iv) load 34 (40 W light bulb) has a resistance value of 360 ohms.

So:
i) Loading Ratio=0.4, i.e. asymmetrical lighting
ii) load 32=48.6 VDC
iii) load 34=121.4 VDC Each light bulb generates very different amounts of light, so much so that only load 34 (the 40 W light bulb) illuminates. Load 34 is generating high quality white light, with high energy efficiency, but with decreased light bulb life.

Experiments have been performed to test the viability of the embodiment illustrated in the figures and obtained the following results:

EXPERIMENTAL TEST RESULTS

| Bulb 1 Rated Wattage | Bulb 2 Rated Wattage | Adapter Mode (2) | Total Lumens | Light Bulb Brightness Symmetry % | Total Real Power Consumption (Watts) | Total Efficiency (Lumens/Watt) | Energy Efficiency Increase Using the Invention (1) | Brightest Light Bulb Life Extension Factor |
|---|---|---|---|---|---|---|---|---|
| 40 | 40 | B.S. | 433 | 50/50 | 40 | 10.8 | −8.7% | 10 |
| 40 | 60 | B.S. | 471 | 65/35 | 47 | 10.0 | −20.3% | 2 |
| 40 | 75 | E.S. | 687 | 80/20 | 50 | 13.8 | +7.1% | 1 |
| 60 | 60 | B.S. | 707 | 50/50 | 60 | 11.9 | −13.9% | 10 |
| 60 | 75 | B.S. | 874 | 60/40 | 65 | 13.4 | −3.5% | 3 |
| 40 | 100 | E.S. | 909 | 95/5 | 53 | 17.3 | +31.6% | 0.5 |
| 75 | 75 | B.S. | 915 | 50/50 | 74 | 12.4 | −10.6% | 10 |
| 75 | 100 | B.S. | 961 | 70/30 | 83 | 11.6 | −19.7% | 1.5 |
| 60 | 100 | E.S. | 1079 | 85/15 | 72 | 15.0 | +8.5% | 0.9 |
| 40 | 150 | E.S. | 1112 | 99/1 | 56 | 19.9 | +48.0% | 0.25 |
| 100 | 100 | B.S. | 1162 | 50/50 | 97 | 11.9 | −22.1% | 10 |
| 40 | 200 | E.S. | 1216 | 100/0 | 57 | 21.5 | +59.5% | 0.2 |
| 75 | 150 | N.B. | 1318 | 90/10 | 93 | 14.1 | −6.5% | 0.75 |
| 100 | 150 | B.S. | 1467 | 65/35 | 114 | 12.8 | −17.2% | 2 |
| 60 | 150 | E.S. | 1479 | 97/3 | 78 | 18.9 | +34.2% | 0.35 |
| 75 | 200 | E.S. | 1526 | 99/1 | 98 | 15.5 | +0.7% | 0.25 |
| 150 | 150 | B.S. | 1645 | 50/50 | 145 | 11.4 | −26.2% | 10 |
| 60 | 200 | E.S. | 1693 | 99/1 | 82 | 20.6 | +43.9% | 0.25 |
| 100 | 200 | N.B. | 1803 | 90/10 | 124 | 14.6 | −5.7% | 0.75 |
| 150 | 200 | B.S. | 2009 | 70/30 | 165 | 12.2 | −22.4% | 1.5 |
| 200 | 200 | B.S. | 2120 | 50/50 | 196 | 10.8 | −34.3% | 10 |

120 VAC, 60 Hz, Standard Incandescent Light Bulbs.
(1) Compared to a Standalone Incandescent Light Bulb of the Same Wattage.
(2) B.S. = Bulb Saver Mode ™, E.S. = Energy Saver Mode ™, N.B. = No Benefit
Bulb Saver Mode: Extended Bulb Life, Some Energy Savings, Colorful Light, but Less Energy Efficiency.
Energy Efficiency Mode: Great Energy Efficiency, Great Energy Savings, Whiter Light, but Shorter Bulb Life.

Furthermore, the following results were obtained from an experiment with Underwriters Laboratories Inc., of 333 Pfingsten Road, Northbrook, Ill. 60062-2096 USA. The results represent successful experimentation on the embodiment illustrated in the figures operating in Energy Efficiency Mode. Note, in the table, the device is identified as "UltraLight™ Lamp Adapter".

TEST SUMMARY
Test start date: May 11, 2004
Model Number: "Ultralight" lamp adapter Test completion date: May 11, 2004

| Test | Philips 40A/WL 40 W, 120 V | Philips 40A/WL, mounted in Ultralight | Philips 100A/WL 100 W, 120 V | |
|---|---|---|---|---|
| Input Power: | 40.91 W | 67.00 W | 102.0 W | (#) |
| Power Factor: | 1.0 | 0.55 | 1.0 | (#) |
| Luminous Flux: | 426.6 lm | 1253 lm | 1530 lm | (#) |
| Lamp Efficacy: | 10.4 lm/w | 18.7 lm/w | 15.0 lm/w | (#) |
| General Color Rendering Index: | 98.7 | 99.2 | 98.9 | (#) |
| Correlated Color Temperature: | 2621 K | 2941 K | 2765 K | (#) |

(#) - Denotes NVLAP accredited data. NVLAP Lab Code 100255-0.

The results contained in this report reflect the results for the particular set of samples sent in for testing. It is the responsibility of the manufacturer to ensure that all production models meet the intent of the requirements detailed within this report.

In use, the device typically provides multiple benefits:

i) To cut energy usage by decreasing the total power consumption of the lighting fixture.

ii) To increase the energy efficiency (lumens/watt) obtainable in the light-generation process performed by incandescent or halogen light bulbs.

iii) To extend the incandescent or halogen light bulb life span (burn time).

iv) To improve the light quality (whiteness) of the generated light.

v) To increase ambient light color.

vi) To help prevent or minimize light bulb burnout at the time of initial turn-on.

At the most basic level, the device transfers electrical power to the sockets of the unit where the incandescent or halogen light bulbs are screwed. The device first takes standard household AC power in at the plural contact base of the unit that is screwed into the lamp fixture (this type of base allows for proper connection to standard one or three level lamp fixtures.). Next, the device illustrated in FIGS. 1 and 2 does a conversion of this AC power to DC, using the Full Wave Bridge Rectifier 18 in parallel with the electrolytic capacitor 22. Finally, this DC power is distributed across the plural light bulbs, which are placed in series to one another.

The following further summarizes the benefits of the embodiment illustrated in FIGS. 1 and 2:

i) By distributing power across plural light bulbs instead of just one, the user has the ability to control how energy is dissipated across each of the plural bulb filaments. When a relatively high-energy dissipation is applied to a bulb's filament, the bulb generates a quality whiter light with a shorter bulb life, but with greatly increased energy efficiency. On the other hand, when a relatively low-energy dissipation is applied to a bulb's filament, a more colorful light is generated with greatly extended bulb life, but with decreased energy efficiency.

ii) DC is typically a far more efficient form of power for illuminating incandescent type lighting than AC power. This is because DC has a far higher energy density than AC. Only DC has a sufficiently high enough energy density for the operation of the embodiment illustrated in the figures.

iii) The electrolytic capacitor 22 used in the full wave rectification process also serves to extend the period of time the light bulb filament takes to go from no light output to fully illuminated, due to its charging capacity. This extended time period serves to decrease thermal shock to the bulb's filament, as well as reducing current surge through the filament at startup, all to help prevent or minimize filament burn out during this initial startup period, when the filament is most vulnerable to blow out.

iv) The embodiment illustrated in the figures is capable of producing a better quality/whiter light by obtaining a higher value on the General Color Rendering Index, as well as obtaining a higher Correlated Color Temperature, than is normally obtainable with AC power alone.

v) In terms of the overall light generation process, this system of light generation, capable of increasing energy efficiency, does so by introducing a reasonable power factor, i.e., a phase shift to the power supply, which returns energy back to the supply. As this device is strictly for residential use, where power factor is free of charge, (unlike for commercial customers), the residential user will, because of this, save money, while using less power.

Figure 3:
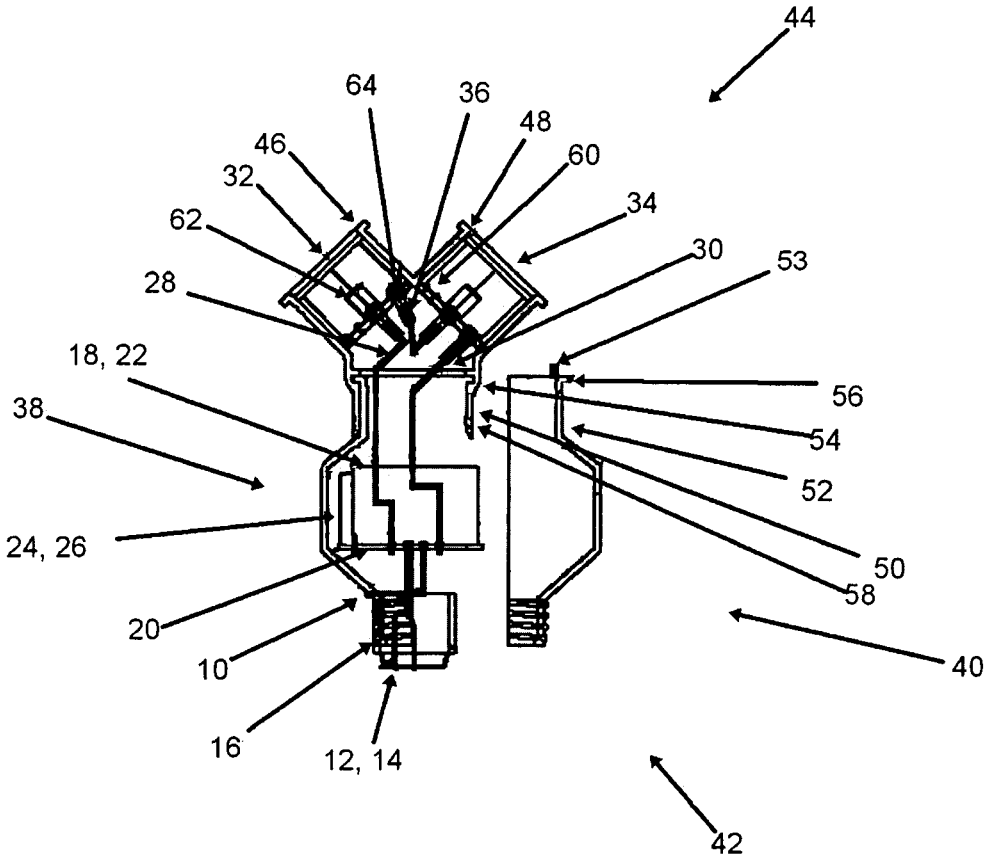
FIG. 3 illustrates the housing which encases the electronics illustrated in FIG. 2.

Turning to FIG. 3, there is illustrated left and right side housing components 38 and 40 for housing components of the invention illustrated in FIGS. 1 and 2. Molded from plastic Polycarbonate, the left and right side housing components 38 and 40 were made in accordance to the UL-94 V0 specification from Underwriters Laboratories, which provides for safety requirements for material thickness and flame retardance. When the left and right side housing components 38 and 40 are coupled, a lower housing 42 is formed.

Disposed on the lower housing 42 is an upper housing 44, which includes left and right sockets 46 and 48. The sockets 46 and 48 are disposed in a "Y" configuration, though any angle can be used so long as the inserted bulbs are appropriately separated.

The upper housing 44 has a bottom section 50 which has a larger outer diameter than a top portion 52 of the lower housing 42. The "Y" configuration allows for swiveling of the upper housing 44, and light bulbs contained therein, around the lower housing 42. Leads 28 and 30 are curled to allow for nearly 360 degrees of rotation without breaking the wires, even after many thousands of repeated rotations. Nonetheless, a physical stop 53 on the right side, lower, plastic housing prevents the upper plastic assembly from rotating beyond the single, full turn. The effect of the swivel feature is to allow for proper alignment of the light bulbs relative to the lamp's harp, which holds the lampshade in place.

A groove 54 on the upper housing 44 and a mating boss 56 on the lower housing 42, as well as a second boss 58 on the upper housing 44 and a second mating groove (not shown) on the lower housing 42 prevent the upper housing 44 from slipping from the lower housing 42.

Disposed in the sockets 46 and 48 in the upper housing 44 are other standard elements for the assembly of the light bulb sockets 46 and 48. These include eyelets 60 and center springs 62. The eyelets 60 are designed to withstand a minimum of 60 lbs of tensile force. It is to be noted that the UL Security of Screwshell (Pull Test) from Underwriters Laboratories requires a design to withstand only 20 lbs of tensile force. Ring terminals, e.g., 64 are used to form electrical junctions.

Solder welds, hot melt adhesion, and ultrasonic bonding are the main assembly techniques used in the making of this product. The application of such techniques would be understood by one of ordinary skill in the art after reading the instant disclosure.

While the invention has been described with reference to the presently preferred embodiment, it should be easily apparent to one skilled in the art that modifications and changes in construction can be incorporated depending on specific use without departing from the true spirit of the invention as defined in the appended claims.

I claim:

1. A device for providing power to plural light-emitting load resistors, comprising:

a first end adapted for connecting with an AC power source and receiving AC input voltage from said AC power source;

a second end adapted for receiving said plural load resistors, each of said plural load resistors having a predetermined load resistance, wherein:

said device transforming said input AC voltage into DC voltage and distributing said DC voltage across said plural load resistors, said voltage delivered to each of said plural load resistors being proportional to said load resistance in each of said plural load resistors; and said device, upon activation, gradually providing power to said plural load resistors, wherein said plural load resistors are electrically connected in series, wherein characteristics of the plural load resistors determine a mode of the device.

2. The device of claim 1, further comprising:

a full wave bridge rectifier connected to said AC power source and receiving input AC voltage and outputting full wave rectified AC voltage; and an electrolytic capacitor connected in parallel between said bridge and said plural load resistors, said capacitor receiving said full wave rectified AC voltage and outputting DC voltage to said plural load resistors.

3. The device of claim 2, further comprising a discharge resistor connected in parallel between said bridge and said capacitor.

4. The device of claim 3, wherein said plural light-emitting load resistors each comprise filaments.

5. The device of claim 4, wherein said plural light-emitting load resistors are incandescent filaments.

6. The device of claim 5, wherein said plural light-emitting load resistors are halogen filaments.

7. The device of claim 6, wherein said plural light-emitting load resistors are light bulbs, said first end comprises a male-threaded socket adapted for connecting with a lamp and said second end comprises a plurality of female-threaded sockets, each adapted for receiving one of said light bulbs.

8. The device of claim 7, further comprising:

a housing, said housing comprising a bottom portion and a top portion;

said bottom portion including a base, said base including said male-threaded socket;

said top portion including said plurality of female-threaded sockets; and said bottom portion adapted for swiveling relative to said top portion.

9. A method for powering plural light-emitting load resistors, comprising:

obtaining a device for powering said plural load resistors;

connecting a first end of said device with an AC power source and receiving AC input voltage from said AC power source;

connecting a second end of said device with said plural load resistors, each of said plural load resistors having a predetermined load resistance;

transforming said input AC voltage into DC voltage and distributing said DC voltage across said plural load resistors, said voltage delivered to each of said plural load resistors being proportional to said load resistance in each of said plural load resistors; and gradually providing power to said plural load resistors, wherein said plural load resistors are electrically connected in series, wherein characteristics of the plural load resistors determine a mode of the device.

10. The method of claim 9, wherein said device further comprises:

a full wave bridge rectifier connected to said AC power source and receiving input AC voltage and outputting full wave rectified AC voltage; and an electrolytic capacitor connected in parallel between said bridge and said plural load resistors, said capacitor receiving said full wave rectified AC voltage and outputting DC voltage to said plural load resistors.

11. The method of claim 10, wherein said device further comprises a discharge resistor, connected in parallel between said bridge and said capacitor.

12. The method of claim 11, wherein said plural light-emitting load resistors each comprise filaments.

13. The method of claim 12, wherein said plural light-emitting load resistors are incandescent filaments.

14. The method of claim 13, wherein said plural light-emitting load resistors are halogen filaments.

15. The method of claim 14, wherein said plural light-emitting load resistors are light bulbs, said first end comprises a male-threaded socket adapted for connecting with a lamp and said second end comprises a plurality of female-threaded sockets, each adapted for receiving one of said light bulbs.

16. The method of claim 15, wherein said device further comprises:

a housing, said housing comprising a bottom portion and a top portion;

said bottom portion including a base, said base including said male-threaded socket;

said top portion including said plurality of female-threaded sockets; and said bottom portion adapted for swiveling relative to said top portion.

* * * * *